US008834090B1

(12) United States Patent
Callens

(10) Patent No.: US 8,834,090 B1
(45) **Date of Patent: *Sep. 16, 2014**

(54) GRAPPLING FORK ATTACHMENT SYSTEM

(76) Inventor: Albert C. Callens, Taunton, MN (US)

( * ) Notice: Subject to any disclaimer, the term of this patent is extended or adjusted under 35 U.S.C. 154(b) by 423 days.

This patent is subject to a terminal disclaimer.

(21) Appl. No.: 13/285,257

(22) Filed: Oct. 31, 2011

Related U.S. Application Data

(63) Continuation-in-part of application No. 12/366,380, filed on Feb. 5, 2009, now Pat. No. 8,061,957.

(51) Int. Cl.
*B66C 1/00* (2006.01)

(52) U.S. Cl.
USPC ..... 414/724; 37/403; 74/89.21; 414/912

(58) Field of Classification Search
CPC . A01D 87/0076; A01D 87/127; A01D 41/16; A01D 87/003; A01D 87/0053; A01D 87/0069; B25J 9/101; B25J 9/045; B25J 9/14; B66F 9/18; B66F 9/065; E02F 3/404; E02F 3/962; E02F 3/401; E02F 3/3668; E02F 3/815; E02F 3/965; E02F 3/142; E02F 3/3604; E02F 3/3609; E02F 3/3631; E02F 3/3672; E02F 9/22
USPC ..... 37/403, 406, 903; 74/89.2, 89.21, 74/89.22; 414/724, 729, 912, 920
See application file for complete search history.

(56) References Cited

U.S. PATENT DOCUMENTS

| | | | | | |
|---|---|---|---|---|---|
| 4,126,234 | A | * | 11/1978 | Wells | 414/24.5 |
| 4,155,473 | A | | 5/1979 | Holopainen | |
| 4,403,906 | A | | 9/1983 | Holopainen | |
| 4,669,947 | A | | 6/1987 | Frost | |
| 4,688,985 | A | | 8/1987 | Hartman | |
| 4,803,788 | A | | 2/1989 | Sorenson | |
| 5,314,292 | A | | 5/1994 | Holopainen | |
| 5,486,085 | A | | 1/1996 | Gagne | |
| 5,577,873 | A | * | 11/1996 | Tanaka et al. | 414/400 |
| 5,639,205 | A | * | 6/1997 | Kaczmarczyk et al. | 414/723 |
| 5,678,332 | A | | 10/1997 | Hawkins | |
| 5,839,322 | A | | 11/1998 | Genov | |
| 5,927,933 | A | | 7/1999 | Tucker | |
| 5,957,650 | A | | 9/1999 | Rollo | |
| 6,109,859 | A | | 8/2000 | Domann | |
| 6,209,237 | B1 | | 4/2001 | Heiple | |
| 6,742,291 | B2 | | 6/2004 | Frigon | |
| 2005/0188568 | A1 | | 9/2005 | Clapper, Jr. | |
| 2005/0193599 | A1 | | 9/2005 | McCoy | |

* cited by examiner

*Primary Examiner* — Saul Rodriguez
*Assistant Examiner* — Ronald Jarrett
(74) *Attorney, Agent, or Firm* — Jason L. Gilbert

(57) ABSTRACT

A system for attaching a grappling fork to a conventional bucket, where the grappling fork does not interfere with the normal use of the bucket. The grappling fork attachment system generally includes a support frame pivotally attached to a tractor between a bucket unit and a pair of loader arms, wherein the support frame may securely attach to either the bucket unit or the pair of loader arms through use of a locking element. An extension frame is pivotally attached to the support frame. A drive assembly comprised of a chain and sprocket configuration is provided one the extension frame for rotating and repositioning the extension frame. A grappling structure is pivotally attached to the extension frame for grabbing and securing a load within the bucket of the tractor. A pair of linkage assemblies are provided on the extension frame for pivoting the grappling structure about the extension frame.

18 Claims, 9 Drawing Sheets

GRAPPLING FORK ATTACHMENT SYSTEM

CROSS REFERENCE TO RELATED APPLICATIONS

I hereby claim benefit under Title 35, United States Code, Section 120 of U.S. patent application Ser. No. 12/366,380 filed Feb. 5, 2009. This application is a continuation-in-part of the Ser. No. 12/366,380 application. The Ser. No. 12/366,380 application is currently pending. The Ser. No. 12/366,380 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an attachment for conventional buckets and more specifically it relates to a grappling fork attachment system for attaching a grappling fork to a conventional bucket, where the grappling fork does not interfere with the normal use of the bucket.

2. Description of the Related Art

Any discussion of the related art throughout the specification should in no way be considered as an admission that such related art is widely known or forms part of common general knowledge in the field.

Grappling forks have been in use for years. Typically, a grappling fork attaches to the upper end of a conventional bucket, with the grappling fork having a single pivot point at the point of attachment. In the grappling forks down position, it rests over the opening of the bucket. This keeps whatever is in the bucket secure and prevents large outside objects from entering the bucket. In a raised position of the grappling fork, it generally sticks straight up into the air, above the bucket. This opens up the bucket to receive or dispense objects.

When past grappling forks have been attached to conventional buckets, it is usually difficult to operate the bucket in a traditional manner. To load objects into the bucket, the grappling fork must be in a raised position. This greatly decreases the operator's view of what they are loading into the bucket.

While these devices may be suitable for the particular purpose to which they address, they are not as suitable for attaching a grappling fork to a conventional bucket, where the grappling fork does not interfere with the normal use of the bucket. Past grappling forks generally have to be removed from the bucket that they are attached to during times when the grappling fork is not needed. This is because the grappling fork can be an obstruction to the operator's view and also can decrease maneuverability of the bucket because of their size.

Because of the inherent problems with the related art, there is a need for a new and improved grappling fork attachment system for attaching a grappling fork to a conventional bucket, where the grappling fork does not interfere with the normal use of the bucket.

BRIEF SUMMARY OF THE INVENTION

The invention generally relates to a grappling fork attachment system which includes a support frame pivotally attached to a tractor between a bucket unit and a pair of loader arms, wherein the support frame may securely attach to either the bucket unit or the pair of loader arms through use of a locking element. An extension frame is pivotally attached to the support frame. A drive assembly comprised of a chain and sprocket configuration is provided one the extension frame for rotating and repositioning the extension frame. A grappling structure is pivotally attached to the extension frame for grabbing and securing a load within the bucket of the tractor. A pair of linkage assemblies are provided on the extension frame for pivoting the grappling structure about the extension frame.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
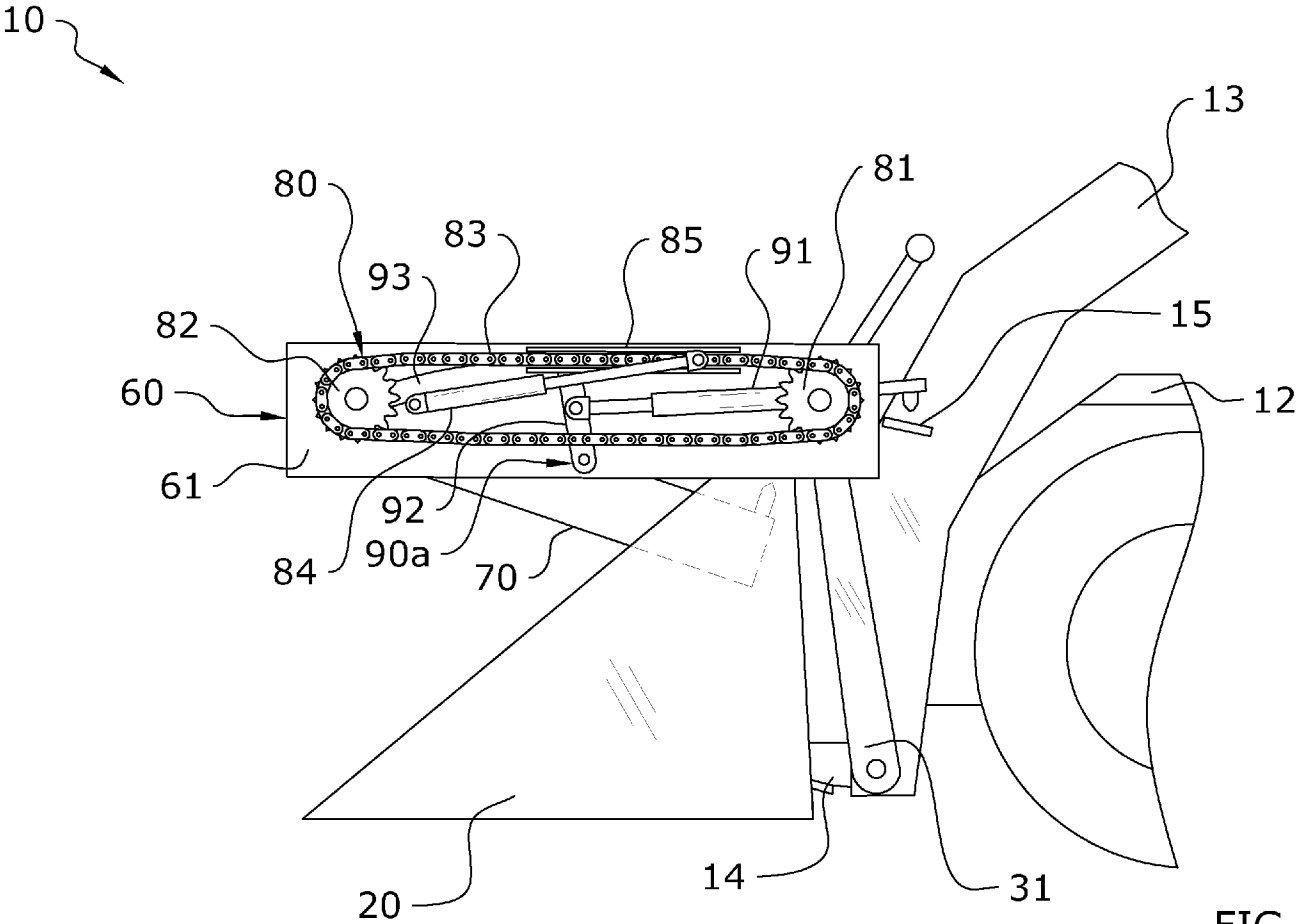
FIG. 1 is a first side view of the present invention with the extension frame in a lowered position.

A. Overview.

Turning now descriptively to the drawings, in which similar reference characters denote similar elements throughout the several views, FIGS. 1 through 9 illustrate a grappling fork attachment system 10, which comprises a support frame 30 pivotally attached to a tractor 12 between a bucket unit 20 and a pair of loader arms 13, wherein the support frame 30 may securely attach to either the bucket unit 20 or the pair of loader arms 13 through use of a locking element 50. An extension frame 60 is pivotally attached to the support frame 30. A drive assembly 80 comprised of a chain 83 and sprocket 81, 82 configuration is provided one the extension frame 60 for rotating and repositioning the extension frame 60. A grappling structure 70 is pivotally attached to the extension frame 60 for grabbing and securing a load within the bucket 20 of the tractor 12. A pair of linkage assemblies 90*a,b* are provided on the extension frame 60 for pivoting the grappling structure 70 about the extension frame 60.

B. Tractor/Skid Steer Loader.

The present invention may attach to various types of machinery 12, such as but not limited to a tractor or a skid steer loader. It is appreciated that the term tractor may be used herein and is not meant to be limited, wherein the present invention may attach to various types of machinery, such as but not limited to tractors, skid steer loaders, vehicles, automobiles, stationary objects, and the like. The present invention preferably attaches at the front end of the machinery and further preferably at the intersecting point between the bucket unit 20 and the loader arms 13.

The bucket unit 20 is comprised of a conventional bucket to carry various sizes of loads (not shown). The bucket unit 20 includes a pair of arm attachments 14 to attach to the loader arms 13 of the tractor/skid steer loader 12. The loader arms 13, when attached to the arm attachments 14, are able to elevate and lower the bucket unit 20.

Figure 3:
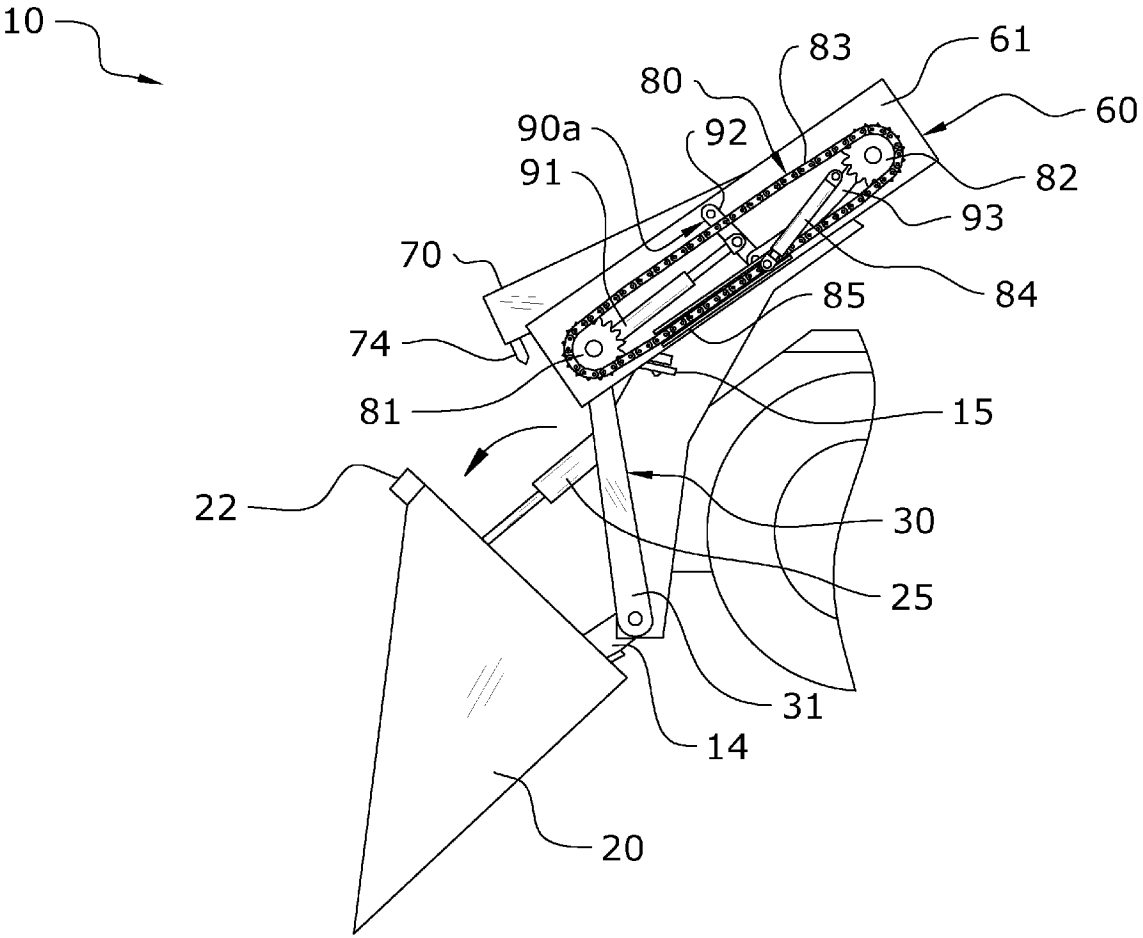
FIG. 3 is a first side view of the present invention illustration movement of the bucket.

The bucket unit 20 preferably also includes at least one actuator 25, preferably of the hydraulic type. The actuator 25 is preferably positioned on the rear of the bucket unit 20 near the upper end, as shown in FIG. 3. The actuator is pivotally secured to the bucket unit 20 via an attachment (not shown). Various hydraulic hoses (not shown) are generally used to supply hydraulic fluid to the various actuators of the present invention as is known in the arts.

The present invention will also generally include a pair of arm retaining flanges 15, to which the locking members 50 of the present invention will removably attach when the present invention is not in use. The arm retaining flanges 15 are generally positioned on the loader arms 13 of the tractor 12 as shown in FIG. 1, wherein a first arm retaining flange 15 is positioned on a first loader arm 13 and a second arm retaining flange 15 is positioned on a second loader arm 13.

The present invention will also generally include a pair of bucket retaining flanges 22 to which the locking members 50 of the present invention will removably attach when the present invention is in use. The bucket retaining flanges 22 are generally positioned at either side of the upper end of the bucket unit 20 as shown in FIG. 3.

C. Support Frame.

Figure 7:
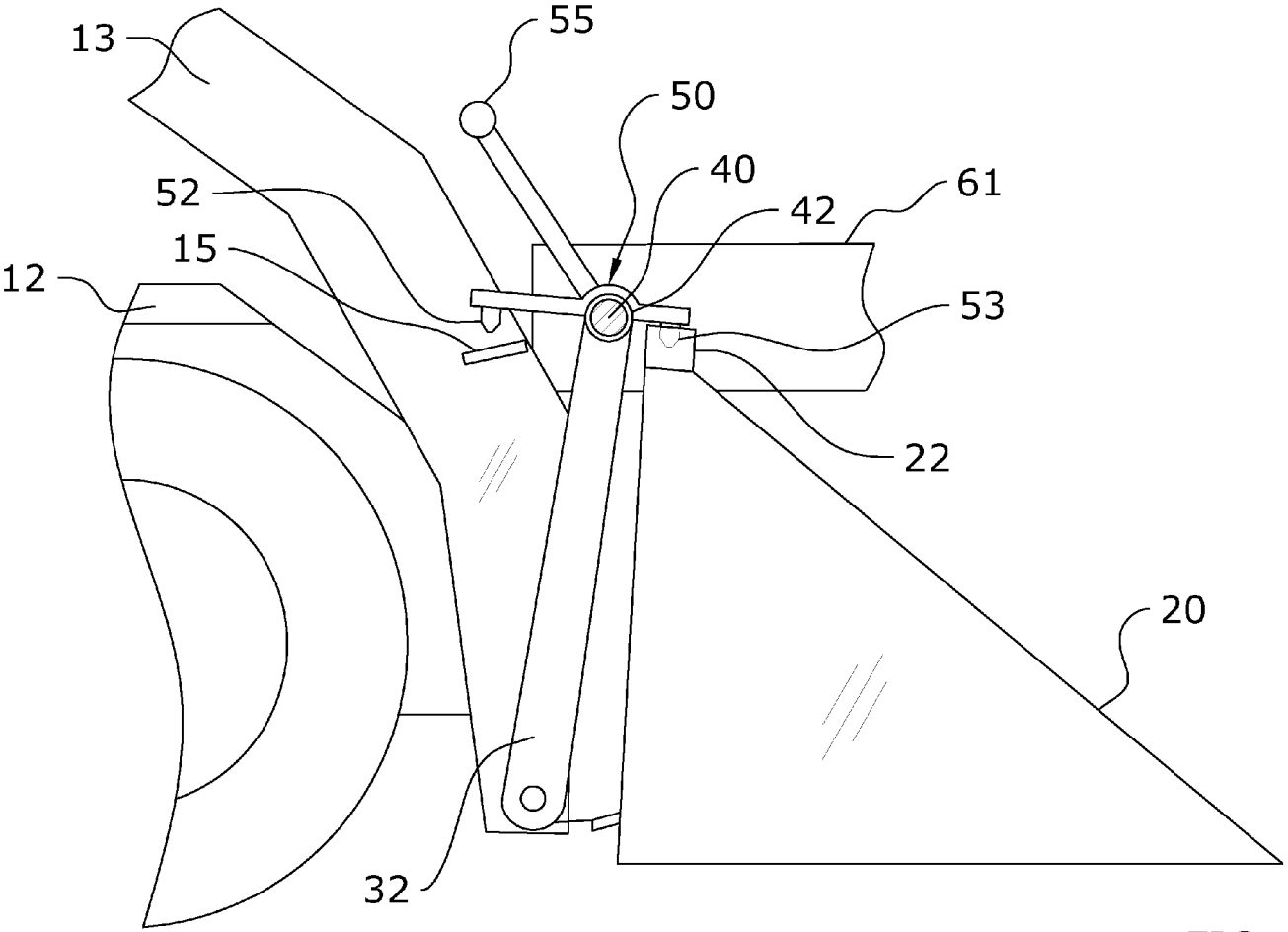
FIG. 7 is a second side view of the locking member of the present invention.
Figure 8:
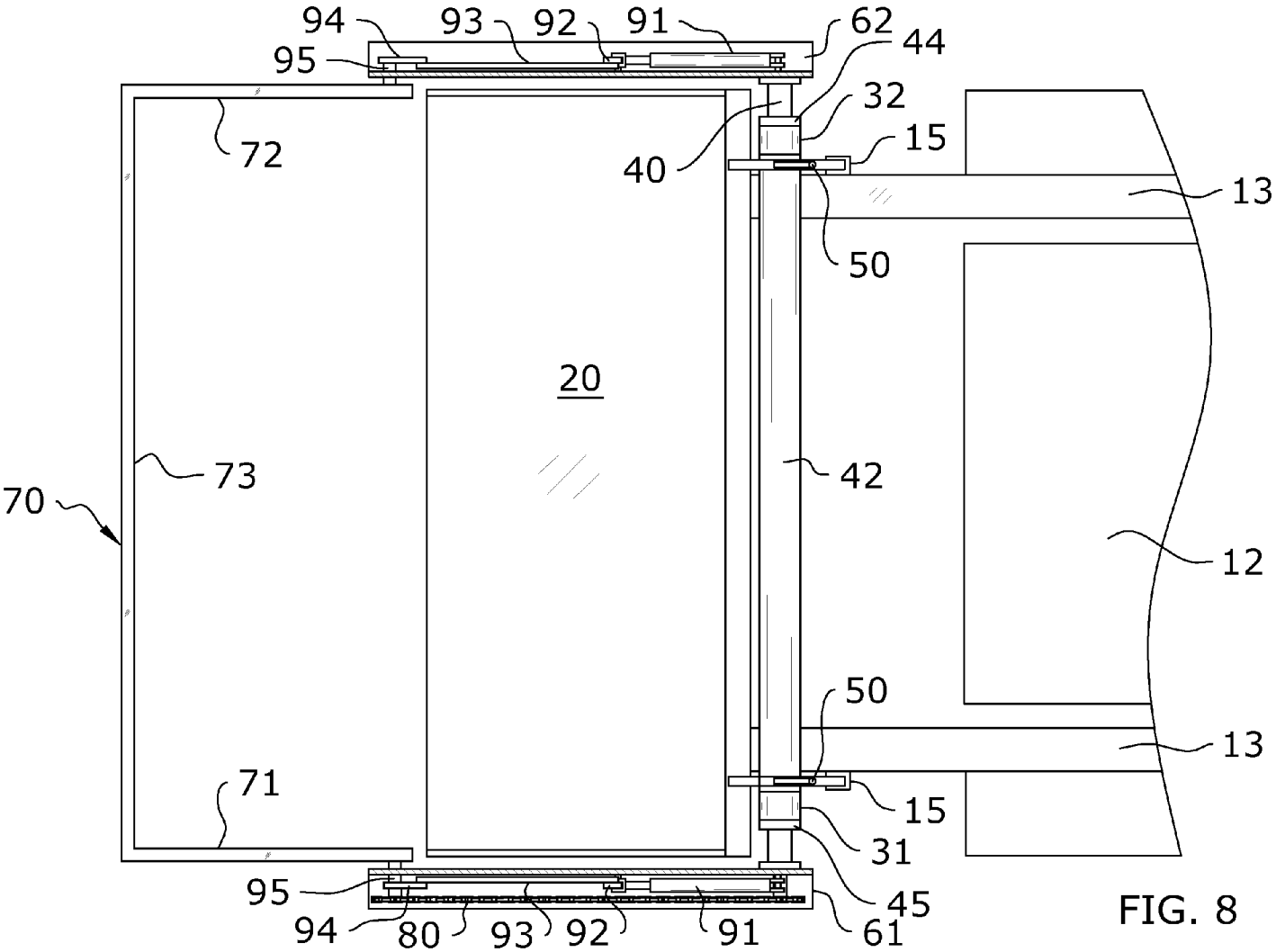
FIG. 8 is a top view of the present invention with the grappling structure extended.
Figure 9:
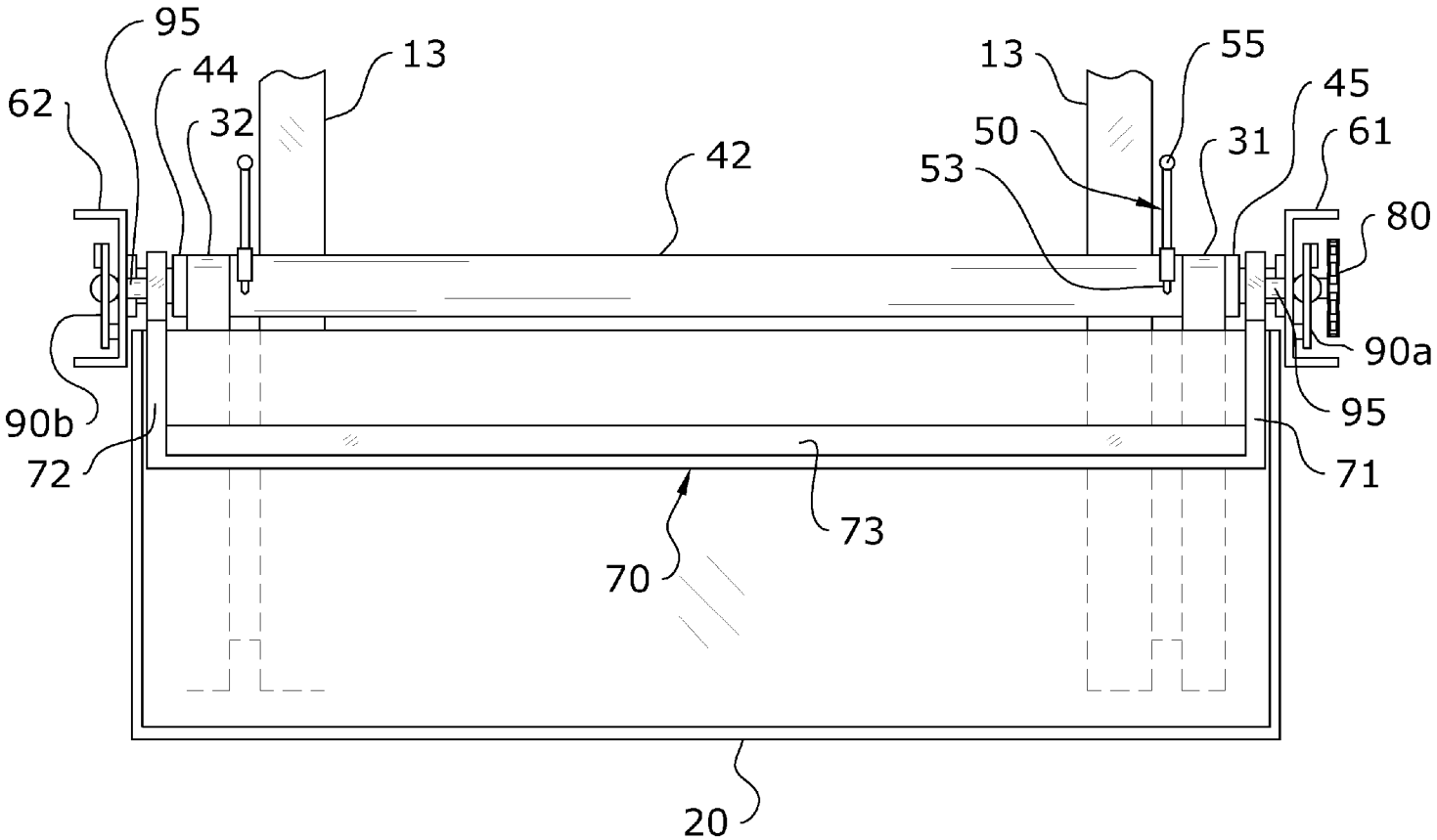
FIG. 9 is a front view of the present invention.

The present invention will also generally include a support frame 30 comprised of a linking structure which attaches at a lower end to the loader arms 13 and at an upper end to the tube member 42 of the present invention as shown in FIGS. 7-9. Generally, a first support member 31 will be attached to the first loader arm 13 and a second support member 32 will be attached to the second loader arm 13. A tube member 42 will generally extend between and be fixedly attached to the upper ends of the respective support members 31 as shown in FIGS. 8-9.

D. Locking Element.

The present invention will also generally include a pair of locking elements 50 which are pivotally attached to tube member 42 to secure the grappling fork attachment 10 to either the bucket unit 20 or the loader arms 13. A first locking element 50 will generally be pivotally attached to the tube member 42 adjacent its first end and a second locking element 50 will generally be pivotally attached to the tube member 42 adjacent its second end as shown in FIG. 8.

Figure 2:
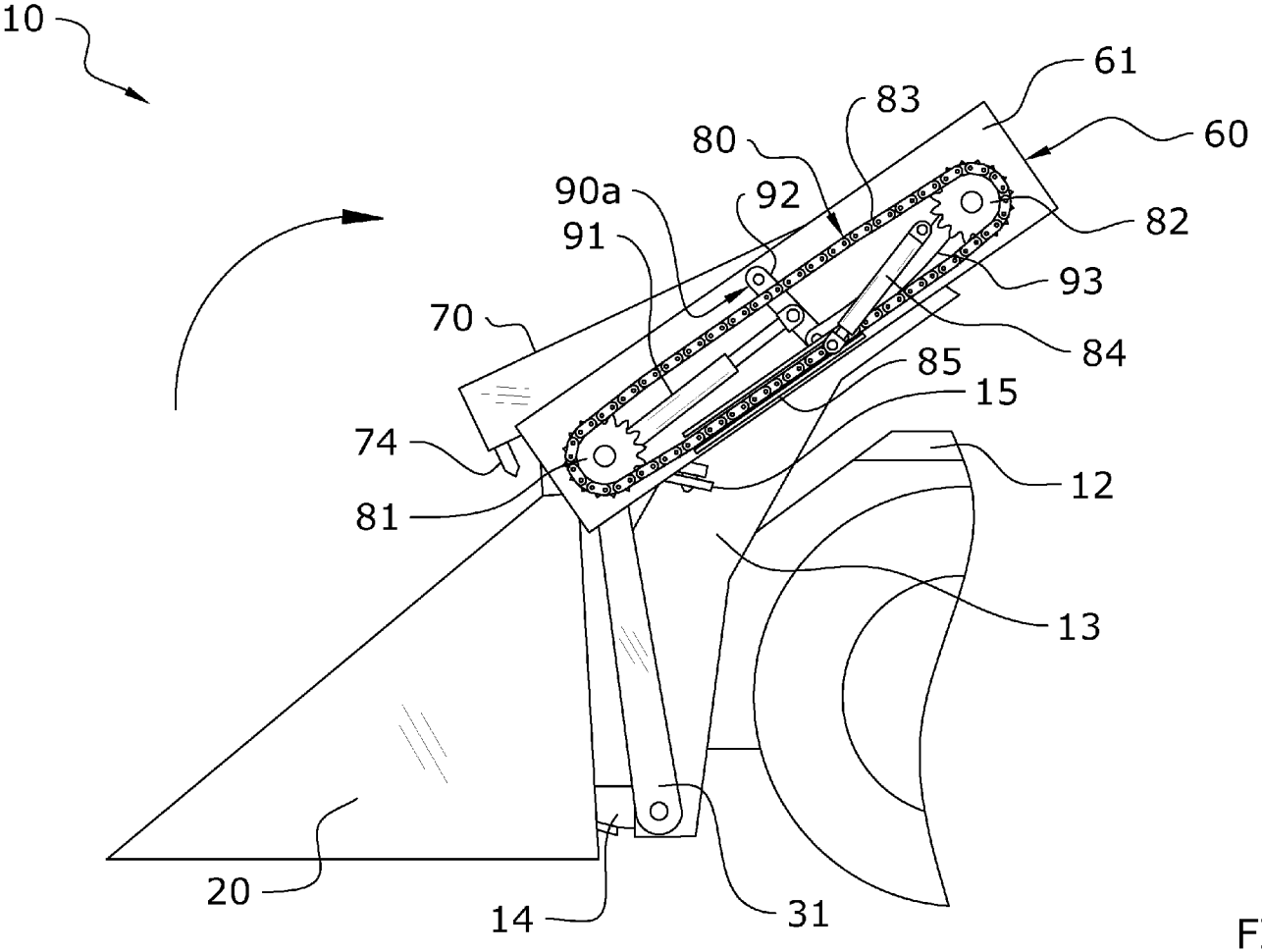
FIG. 2 is a first side view of the present invention with the extension frame in a raised position.

The locking elements 50 are preferably comprised of a rocker arm configuration. Each locking element 50 includes a first securing portion 52 which may be removably secured within a slot of a corresponding arm retaining flange 15 of the loader arms 13 as shown in FIG. 2. When the locking elements 50 are secured within the arm retaining flange 15, the present invention will be retracted and out of the way of normal operation of the tractor 12 and bucket unit 20 as shown in FIGS. 2 and 3.

Figure 4:
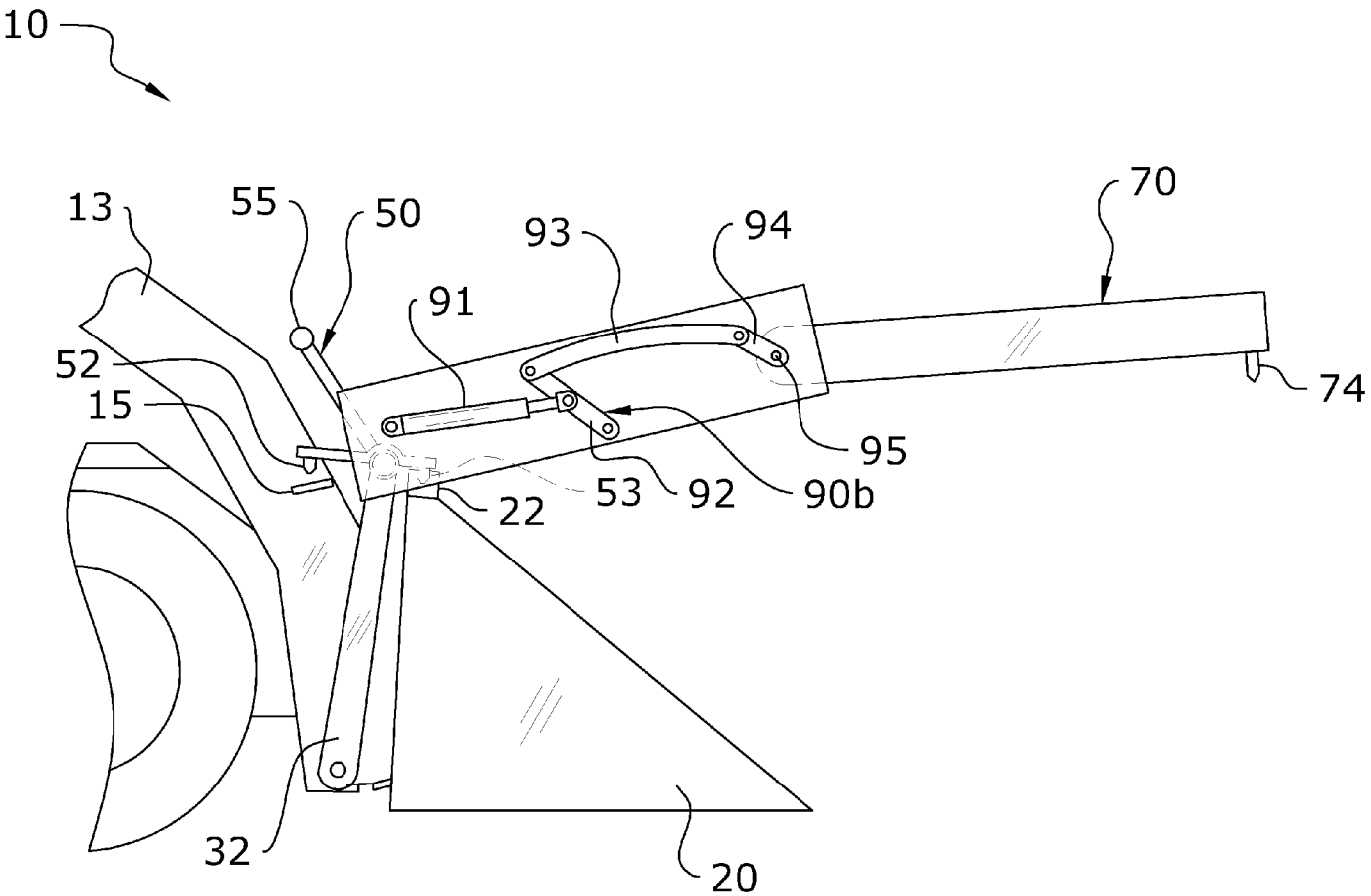
FIG. 4 is a second side view of the present invention illustrating the grappling structure in an extended position.
Figure 5:
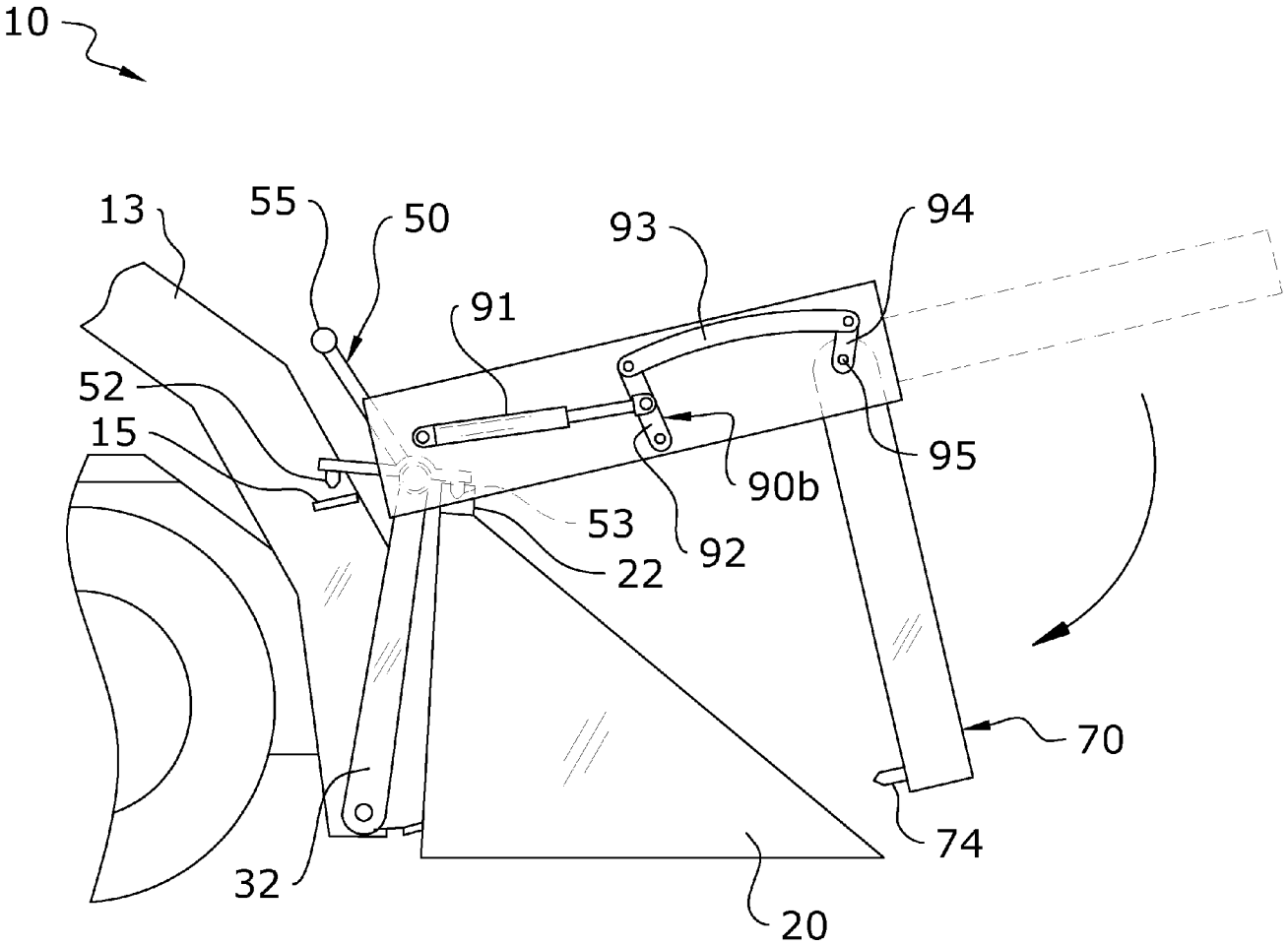
FIG. 5 is a second side view of the present invention illustrating movement of the grappling structure between its extended position and its retracted position.
Figure 6:
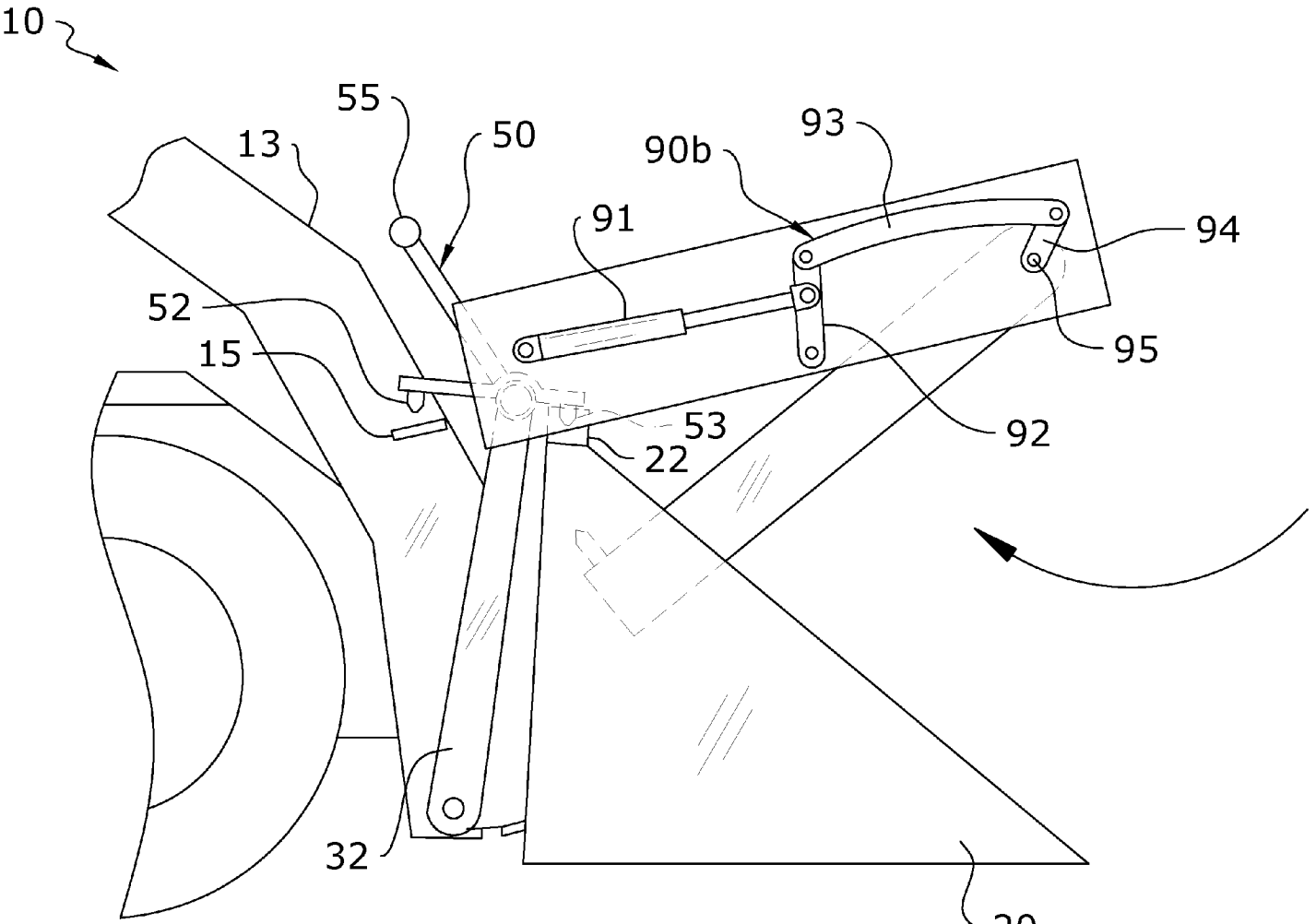
FIG. 6 is a second side view of the present invention illustrating the grappling structure in a retracted position.

Each locking element 50 will also generally include a second securing portion 53 which may be removably secured within a slot of a corresponding bucket retaining flange 22 of the bucket unit 20 as shown in FIG. 4. When the locking elements 50 are secured within the bucket retaining flange 22, the present invention will be extended and ready for use as shown in FIGS. 4, 5 and 6.

Each locking element 50 will generally include a grip portion 55 extending upwardly or diagonally upwardly from a central portion between the first and second securing portions 52, 53 as shown in FIG. 7. The grip portion 55 is utilized to rotate the locking element 50 to engage alternatively with the arm retaining flange 15 or bucket retaining flange 22. In some embodiments, the grip portion 55 may be automatically or mechanically movable into different positions from within the cab of the tractor 12 through motion of hydraulics or other structures.

E. Cross Member.

The support frame 30 will generally include a cross member 40 which extends between the first and second extension arms 61, 62 as shown in FIG. 8. The cross member 40 will preferably be fixedly secured to the extension arms 61, 62. The cross member 40 will generally be comprised of a thick, torque-resistant tube or pipe which links the first and second extension arms 61, 62 of the extension frame 60.

A tube member 42 may be provided which extends from the outer upper edge of the first support member 31 to the outer upper edge of the second support member 32 as shown in FIGS. 8 and 9. The tube member 42 is fixedly attached to the upper ends of the support members 31, 32. The tube member 42 provides the necessary torque resistance to stabilize the support frame 30.

The support frame 30 is pivotally connected to the extension frame 60 through use of the cross member 40 and tube member 42. The cross member 40 is positioned within the tube member 42 in a manner which allows the cross member to freely rotate within the tube member 42 before the cross member 40 is fixedly secured to the first and second extension arms 61, 62. Such a configuration creates the pivot point between the support frame 30 and the extension frame 60.

In some embodiments of the present invention, a pair of ring members 44, 45 are fixedly attached to the cross member 40 adjacent the respective ends of the tube member 42 as shown in FIG. 8. The ring members 44, 45 will prevent the tube member 42 from shifting with respect to the cross member 40.

F. Extension Frame.

The extension frame 60 is comprised of a structure and configuration to pivotally attach to the rear of the bucket unit 20 via the support frame 30. The extension frame 60 preferably includes a pair of extension arms 61, 62 to extend across the bucket unit 20 toward a front of the bucket unit 20 so as to extend over a load within the bucket 20 as shown in FIG. 1.

The extension arms 61, 62 may be comprised of various types of structures which may accommodate the drive assembly 80 and linkage assemblies 90*a,b* of the present invention. In a preferred embodiment, each extension arm 61, 62 may be comprised of a channel iron or similar structure. The extension arms 61, 62 are preferably comprised of the same structure and are substantially parallel to each other.

The extension arms 61, 62 are generally attached to the respective ends of the cross member 40 as shown in FIG. 8. The arms 61, 62 will generally pivot with respect to the cross member 40 through use of the drive assembly 80 of the present invention. The grappling structure 70 will also generally be secured to the front end of the extension frame 60 as shown in FIG. 2.

G. Grappling Structure.

The grappling structure 70 is comprised of a structure and configuration to pivotally attached to the extension frame 60 as shown in the figures. The grappling structure 70 preferably includes a pair of side arms 71, 72 and a cross arm 73 connecting the side arms 71, 72 at an outward end so as to be furthest away from the bucket unit 20. The side arms 71, 72 are preferably comprised of a similar configuration and are substantially parallel to each other. The grappling structure 70 is positioned upon an inside of the extension frame 60.

The cross arm 73 is comprised of a structure and configuration to secure a load in the bucket unit 20. The cross arm 72 may include a plurality of hooks 74. The hooks 74 preferably extend perpendicular toward the ground when the grappling structure 70 is parallel with the ground, as shown in FIG. 4. The hooks 74 serve to better grab a load when using the present invention.

H. Drive Assembly.

The present invention will generally utilize a drive assembly 80 to control pivoting motion of the extension frame 60. The drive assembly 80 will be positioned on one of the extension arms 61, 62 of the extension frame 60. It is appreciated that the drive assembly 80 may be placed on either extension arm 61, 62 without affecting the overall operation of the present invention. Further, in some embodiments, two drive assemblies 80 may be utilized. The drive assembly 80 and actuator 84 may be controlled via hydraulic fluid and/or electrical components from within the cabin of the tractor 12.

As shown in FIG. 1, a preferred embodiment will utilize a drive assembly 80 positioned on the first extension arm 61. The drive assembly 80 will generally include a pair of sprockets 81, 82 which are linked by a chain 83. A portion of the chain 83 extends through a chain guide 85 as shown in FIG. 1. An actuator 84 is fixedly attached at one end to the first extension arm 61 and at the other end to the chain 83. Thus, activation of the actuator 84 may cause the chain 83 to advance or recede through the chain guide 85 and thus rotate with respect to the sprockets 81, 82.

The first sprocket 81 is positioned at the rear end of the first extension arm 61 as shown in FIG. 1. The first sprocket 81 is preferably fixedly secured to the first support member 31 in a manner which prevents rotation. The second sprocket 82 is permitted to freely rotate. When the actuator 84 is extended, it will rotate the chain 83 and second sprocket 82 clockwise, which causes the cross member 40 and extension frame 60 to rotate counter clockwise into a lowered position as shown in FIG. 1. The extension frame 60 may be locked in such a position by engaging the locking element 50 with the bucket retaining flange 22.

When the actuator 84 is retracted, the extension frame 60 will rotate clockwise into a raised position as shown in FIG. 2. The locking element 50 will engage with the arm retaining flange 15 to secure the extension frame 60 in a position which will not interfere with normal operation of the tractor 12 and bucket unit 20.

I. Linkage Assemblies.

The present invention will generally include a pair of linkage assemblies 90*a,b* for pivoting the grappling structure 70 into and out of position. Generally, a first linkage assembly 90*a* will be positioned on the outer end of the first extension arm 61 and a second linkage assembly 90*b* will be positioned on the outer end of the second extension arm 62 as shown in FIG. 9. In a preferred embodiment, the linkage assemblies 90*a,b* will be comprised of a master-slave arrangement, wherein hydraulic power is provided to only the master linkage assembly 90*a* while the slave linkage assembly 90*b* mirrors movement of the master linkage assembly 90*a*.

Each linkage assembly 90*a,b* will generally be comprised of an actuator 91 and a plurality of link members 92, 93, 94 as shown in FIG. 4. Each link member 92, 93, 94 is preferably comprised of an elongated member of varying lengths. It is notable that the specific length of each of the link members 92, 93, 94 may vary and should not be construed as being limited to the exemplary arrangement shown in the figures.

The actuator 91 is preferably fixedly attached at one end to the outer surface of the extension arm 61, 62 and pivotally attached at the other end to the first link member 92. The first link member 92 is preferably fixedly attached at one end to the outer surface of the extension arm 61, 62 and pivotally attached at its other end to the first end of the second link member 93. The second link member 93 is preferably rotatably attached at its first end to the second end of the first link member 92 and rotatably attached at its second end to the first end of the third link member 94. The third link member 94 is preferably rotatably attached at its first end to the second end of the second link member 93 and at its second end to a mount member 95.

Each linkage assembly 90*a,b* includes a mount member 95 which connects the third link member 94 with the corresponding side arm 71 of the grappling structure 70. Thus, force applied to the link members 92, 93, 94 by the actuator 91 will be transferred to cause the grappling structure 70 to raise and/or lower.

When fully extended, the actuator 91 will cause the link members 92, 93, 94 to shift and retract the grappling structure 70 to its rested position as shown in FIGS. 2 and 3. By retracting the actuator 91 (generally achievable from the cabin of the tractor 12 through use of controllers and hydraulics as known in the art), the grappling structure 70 will extend out to secure a load as shown in FIGS. 4 and 5.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A grappling fork attachment system, comprising:

a tractor including a bucket unit and a pair of loader arms, wherein said pair of loader arms move said bucket unit;

a support frame attached to said tractor;

an extension frame pivotally attached to said support frame;

a drive assembly mounted proximate said extension frame for pivoting said extension frame about said support frame;

a grappling structure pivotally attached to said extension frame for grabbing and securing a load within said bucket unit;

at least one linkage assembly mounted proximate said extension frame for pivoting said grappling structure about said extension frame; and wherein said support frame is pivotally attached to said tractor between said pair of loader arms and said bucket unit; and at least one locking element pivotally connected to said support frame to alternately secure said support frame to one of said bucket unit and said pair of loader arms.

2. The grappling fork attachment system of claim 1, wherein said bucket unit moves independent of said support frame when said locking element is secured to said pair of loader arms.

3. The grappling fork attachment system of claim 1, wherein said locking element is comprised of a rocker arm.

4. The grappling fork attachment system of claim 1, wherein said grappling structure is positioned completely behind said bucket unit in a resting position and positioned at least partially above said bucket unit in an in use position.

5. The grappling fork attachment system of claim 1, wherein said drive assembly includes a chain, a first sprocket and a second sprocket.

6. The grappling fork attachment system of claim 5, wherein said first sprocket is fixedly attached to said support frame.

7. The grappling fork attachment system of claim 1, wherein said at least one linkage assembly includes an actuator and a plurality of link members.

8. The grappling fork attachment system of claim 1, wherein said support frame includes a first support member and a second support member, wherein said support frame includes a tube member extending between said first support member and said second support member.

9. The grappling fork attachment system of claim 8, further comprising a cross member rotatably positioned within said tube member, wherein said extension frame includes a first extension arm and a second extension arm, wherein said cross member is attached at a first end to said first extension arm and at a second end to said second extension arm.

10. A grappling fork attachment system, comprising:

a tractor including a bucket unit and a pair of loader arms, wherein said pair of loader arms move said bucket unit;

a support frame attached to said tractor, wherein said support frame includes a tube member;

a cross member extending through said tube member, wherein said cross member is adapted to rotate within said tube member;

an extension frame attached to said cross member, wherein said extension frame includes a first extension arm and a second extension arm;

a drive assembly mounted proximate said first extension arm for pivoting said extension frame about said support frame;

a grappling structure pivotally attached to said extension frame for grabbing and securing a load within said bucket unit;

a first linkage assembly mounted proximate said first extension arm for pivoting said grappling structure about said extension frame;

a second linkage assembly mounted proximate said second extension arm for pivoting said grappling structure about said extension frame;

wherein said support frame is pivotally attached to said tractor between said pair of loader arms and said bucket unit; and at least one locking element pivotally connected to said support frame to alternately secure said support frame to one of said bucket unit and said pair of loader arms.

11. The grappling fork attachment system of claim 10, wherein said first extension arm is connected to a first end of said cross member and wherein said second extension arm is connected to a second end of said cross member.

12. The grappling fork attachment system of claim 10, wherein said bucket unit moves independent of said support frame when said locking element is secured to said pair of loader arms.

13. The grappling fork attachment system of claim 10, wherein said locking element is comprised of a rocker arm.

14. The grappling fork attachment system of claim 10, wherein said grappling structure is positioned completely behind said bucket unit in a resting position and positioned at least partially above said bucket unit in an in use position.

15. The grappling fork attachment system of claim 10, wherein said drive assembly includes a chain, a first sprocket and a second sprocket.

16. The grappling fork attachment system of claim 10, wherein said first linkage assembly and said second linkage assembly are comprised of a master-slave configuration.

17. The grappling fork attachment system of claim 10, wherein said support frame includes a first support member and a second support member, wherein said tube member extends between said first support member and said second support member.

18. A grappling fork attachment system, comprising:

a tractor including a bucket unit and a pair of loader arms, wherein said pair of loader arms move said bucket unit;

a support frame attached to said tractor, wherein said support frame includes a tube member;

an extension frame pivotally attached to said support frame, wherein said extension frame includes a first extension arm and a second extension arm;

a drive assembly mounted proximate said first extension arm for pivoting said extension frame about said support frame, wherein said drive assembly is comprised of a pair of sprockets, a chain, a chain guide and an actuator;

a grappling structure pivotally attached to said extension frame for grabbing and securing a load within said bucket unit;

a first linkage assembly mounted proximate said first extension arm for pivoting said grappling structure about said extension frame, wherein said first linkage assembly is comprised of an actuator, a plurality of link members and a mount member, wherein said mount member is attached to a first end of said grappling structure;

a second linkage assembly mounted proximate said second extension arm for pivoting said grappling structure about said extension frame, wherein said second linkage assembly is comprised of an actuator, a plurality of link members and a mount member, wherein said mount member is attached to a second end of said grappling structure;

wherein said support frame is pivotally attached to said tractor between said pair of loader arms and said bucket unit; and at least one locking element pivotally connected to said support frame to alternately secure said support frame to one of said bucket unit and said pair of loader arms.

* * * * *